US005148618A

United States Patent [19]

Brewster

[11] Patent Number: 5,148,618

[45] Date of Patent: Sep. 22, 1992

[54] SEALED TAG

[76] Inventor: Blair M. Brewster, 297 Henry St., Brooklyn, N.Y. 11201

[21] Appl. No.: 782,882

[22] Filed: Oct. 18, 1991

Related U.S. Application Data

[63] Continuation of Ser. No. 531,933, Jun. 1, 1990, abandoned.

[51] Int. Cl.[5] ..... G09F 3/02

[52] U.S. Cl. ..... 40/626; 40/152; 40/661

[58] Field of Search ..... 40/626, 152, 661, 159.2

[56] References Cited

U.S. PATENT DOCUMENTS

| | | | |
|---|---|---|---|
| 3,200,527 | 8/1965 | Clark | 40/152 |
| 3,798,806 | 3/1974 | Sanford | 40/455 |
| 3,808,722 | 5/1974 | Byers et al. | 40/152 |
| 4,079,529 | 3/1978 | Jennen et al. | 40/152 |
| 4,104,818 | 8/1978 | Hrabik | 40/152 |
| 4,270,287 | 6/1981 | Gimbel | 40/152 |
| 4,276,704 | 7/1981 | Heller | 40/661 |
| 4,467,541 | 8/1984 | Pettersson | 40/159.2 |
| 4,477,991 | 10/1984 | Drevitch et al. | 40/159.2 |
| 4,583,309 | 4/1986 | Kane et al. | 40/152 |
| 4,648,189 | 3/1987 | Michel | 40/626 X |
| 4,787,158 | 11/1988 | Vitol | 40/638 |
| 4,827,648 | 5/1989 | Danin | 40/152 X |
| 4,907,359 | 3/1990 | Berman | 40/299 |

FOREIGN PATENT DOCUMENTS

| | | | |
|---|---|---|---|
| 104348 | 2/1917 | United Kingdom | 40/299 |

*Primary Examiner*—James R. Brittain
*Assistant Examiner*—Milton Nelson, Jr.
*Attorney, Agent, or Firm*—Cumpston & Shaw

[57] ABSTRACT

A label in accordance with the present invention includes a base having a transparent window and an adjacent frame at least substantially surrounding the window, the frame being at least somewhat thicker than the window; a locating projection on the base for repeatably positioning an indicia bearing insert at least partially within the window; alignment holes on the frame; a cover having a transparent window portion and an adjacent frame portion at least substantially surrounding the window portion; alignment projections cooperating with the alignment holes for positioning the cover and base relative to each other with the transparent window portions of the cover and base at least substantially in registration; and at least one seal formed between the cover and the base at least substantially surrounding the window portions of the cover and the base for forming a sealed pocket for receiving an indicia bearing insert.

7 Claims, 3 Drawing Sheets

SEALED TAG

This is a continuation of copending application Ser. No. 07/531,933 filed on Jun. 1, 1990, now abandoned on Oct. 18, 1991.

This invention relates generally to indicia bearing signs or tags and more particularly to a sealed tag assembly of particular utility in providing bar code labels in radioactive environments.

Many industrial applications and particularly thermonuclear generating plants require tags or labels for various equipment, valves, switches and other apparatus and controls to enable operators to quickly identify, inventory or otherwise locate and select from among similar looking articles.

Recently, it has become desirable to provide tags or labels with machine readable indicia such as bar codes, particularly for inventory purposes, but also for identifying equipment such as valves, pumps, instruments, tanks and the like that have been repaired or replaced, read in the case of instruments; or adjusted or the like in the case of valves and other controls. In areas where high levels of radioactivity are present it is important that the tags or labels be immediately readable both to operators and by bar code scanners. Operators must enter and leave radioactive areas quickly. Delay in reading a sign can cause the operator to be unduly exposed to excess radiation. This issue is called throughout the industry an ALARA concern (As Low As Reasonably Achievable). While sophisticated bar code scanners can eventually read even not very clear labels, providing a tag or sign having a high first time read rate may be critical in hazardous environments.

Radioactive environments such as nuclear plants have additional stringent requirements on tags or signs. The signs must be UV stable, must not contain chlorine, and must be easy to decontaminate. Small or microscopic radioactive fleas tend to work their way into cracks and crevices, unsealed assemblies and the like. Fleas come from spent fuel. Fuel rods are highly radioactive. It is essential that tags or signs designed for use in a radioactive environment be resistant to picking up such fleas, and easy to decontaminate. Parts having crevices can spread the fleas to an operator. They are hard to detect, yet can cause sterility.

Because extremely dangerous situations can be created by accidental mislabelling, as might occur if a marker falls off a control, or is intentionally altered by vandals, it is critical that tags in the nuclear industry be sturdy, permanently mounted and vandal resistant. Studies have shown that over 54% of accidents in nuclear plants are directly or indirectly related to improper or unreadable tags, including moved tags or vandalized tags.

It is desirable to provide a tag or label that can be printed and assembled on site so as to provide the capability for immediately replacing a tag that has been accidentally destroyed, for labelling newly installed equipment and relabelling existing equipment as necessary due to changes, and the like.

Heretofore, while tags or signs have been available that are more or less suitable for use by the nuclear industry, all such tags or signs have suffered from one or more disadvantages related to the above mentioned requirements. For example, a commonly employed sign is printed on paper which is then embedded in fiberglass. Such a tag has a number of disadvantages. Fiberglass is hydroscopic and the absorption of water makes the fiberglass hazy and any indicia on the tag, particulary bar code indicia, more difficult to read. Fiberglass blooms and the individual fibers become whiter after time. This also increases the difficulty of reading the indicia, particularly the bar code indicia. Fiberglass coated paper is, even in the absence of water absorption and blooming, more difficult to read than uncoated paper because the indicia are covered by a layer of material that is at best only close to transparent which must be optically penetrated by a bar code reader to read the coded indicia. In order to provide fiberglass embedded paper signs of sufficient strength to prevent their being easily broken, the signs must be quite thick, which further increases the difficulty of reading them. The fiberglass coating on printed paper labels causes the ink on the paper to bleed at least slightly and this makes the labels harder to read. Polyester based labels which exhibit significantly less bleeding cannot be used as an insert for fiberglass coated labels because the fiberglass does not penetrate the polyester and the overall assembly tends to fall apart. In addition, where the paper labels are printed on a laser printer, the toner tends to dissolve in the fiberglass embedment/coating process and this also causes bleeding. Fiberglass labels therefore provide less than ideal solution to labelling requirements.

Another commonly employed label has a laminated printed label attached to a metal substrate. The process for making such a label is relatively complicated and includes the steps of laser printing the label, setting up a laminater, over laminating the label, renewing the laminater setup, underlaminating the label, setting up the die cutter, die cutting the labels, stripping premask from the metal substrate, aligning the label with the substrate and adhering the two, and punching the assembled tag with the required number of holes. The foregoing steps will produce a one-sided label. Where a two-sided label is needed, the laser printing, laminating and mounting steps must be repeated for each side.

A label in accordance with the present invention overcomes many of the disadvantages of known labels in a tamper resistant sealed tag particularly designed for use in a radioactive environment, and including:

a base having a transparent window and an adjacent frame at least substantially surrounding the window, the frame being at least somewhat thicker than the window;

a first upstanding rib on the base for receiving and positioning an indicia bearing insert at least partially within the window;

first alignment means on the frame;

a cover having a transparent window portion and an adjacent frame portion at least substantially surrounding the window portion;

second alignment means cooperating with the first alignment means for aligning the cover and base relative to each other with the transparent window portions of the cover and base at least substantially in registration; a recess in the cover for engaging the first upstanding rib; and at least one seal formed between the cover and the base at least substantially surrounding the window portions of the cover and the base for forming a sealed pocket for receiving an indicia bearing insert.

A tag in accordance with this invention has a number of advantages over known tags. The tag is particularly well suited for providing information on one or two sides. A universal tag holder can readily be fabricated that will hold a two-sided or one-sided insert without change.

The tag of the present invention utilizes easy to line up plastic inserts that can be laser printed on site and readily aligned on the base through the use of the locating means. The tag body is preferable made from polyester or a Lexan polycarbonate resin and the seals are formed by ultrasonically welding the cover and base in a loop formed in the frame portion of the cover and base, to seal the indicia bearing label within the tag. In an alternative construction, the tag of the present invention can be easily assembled on site and is particularly well adapted to the use of labels printed from computer data bases. The alternative construction is not sonically welded. It is assembled with pressure alone. The seals are formed at approximately the same locations as the ultrasonic seals, but are not welded, relying solely on pressure.

The tag of the present invention is thicker at the edges than in the center and, even when it is provided with through holes in accordance with the present preferred embodiment of the invention is particularly strong in the otherwise potentially weakened region of the holes.

The present tag is watertight and easy to decontaminate. The smooth outer profile and preferable double weld of the present tag make decontamination and removal of radioactive fleas much easier than is the case with previously known tags.

The present tag allows easy customization for a wide range of mounting approaches, such as vertical or horizontal orientation. The tag can be readily made with a number of holes well suited for a variety of particular applications.

The present tag can be readily manufactured in an adhesive stick-on configuration. The outer surface of the flat cover is particuarly well suited for receiving a layer of adhesive to adhere the tag to a flat surface. In a preferred embodiment of the invention, the top radius of the tag is smaller than the bottom radius of the tag, thereby making it more difficult to pry the tag off a door, tank or other piece of equipment.

It is a feature of a preferred embodiment of the invention to provide a matte finish for reducing glare.

While the novel aspects of the invention are described with particularlity in the appended claims, the invention itself together with further objects and advantages thereof may be more readily understood by reference to the following detailed description of a presently preferred emodiment of the invention taken in connection with the accompanying in which:

Figure 11:
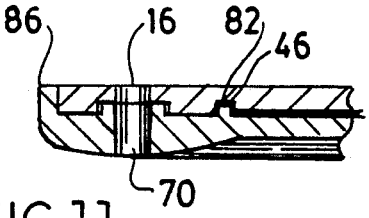
Figure 12:
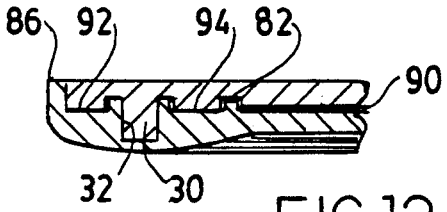

FIG. 11 is a segmental sectional detail of the assembled base top members taken along line 9—9 of the base and 5—5 of the cover; and FIG. 12 is a segmental sectional detail of the assembled base and top members taken along lines 6—6 of the base and 10—10 of the cover.

Figure 1:
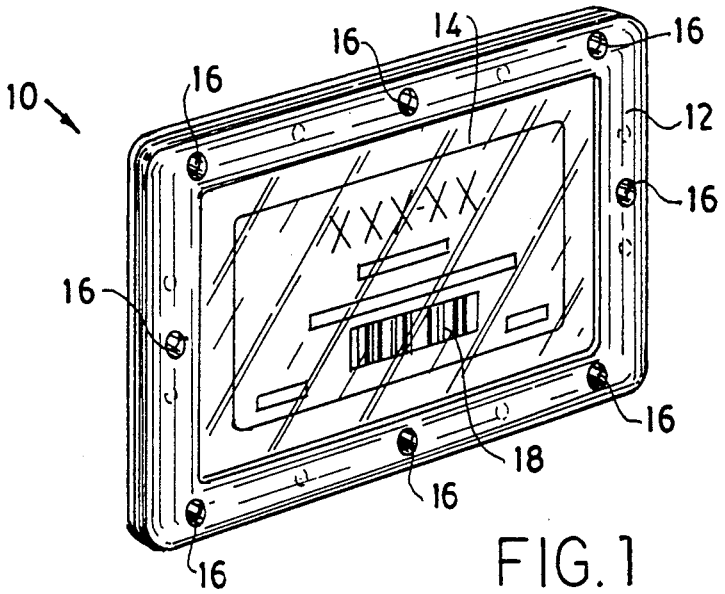
FIG. 1 is a perspective view of a tag in accordance with this invention.

A sealed label or tag in accordance with this invention is shown in FIG. 1. The tag 10 (as used herein "tag" is intended to comprehend tags, signs, labels, and the like, having the construction described herein) is generally rectangular in peripheral shape, and has a generally rectangular frame 12 surrounding an at least substantially transparent viewing window 14. A plurality of through holes 16 is provided in the frame for attaching the tag to an article to be labelled. Preferably, the tag is manufactured from clear thermoplastic material, such as polycarbonate resin of the type sold under the trademark Lexan. The material is selected to be chlorine free and suitable for ultrasonic welding.

Preferably, the tag bears identifying indicia such as alpha-numeric indicia indicated by the series of X's and machine readable bar code indicia 18. The transparent window portion of tag 10 is selected to permit the bar code indicia 18 to be read by a conventional scanning wand or the like, and is preferably about 0.044 inches thick.

Figure 2:
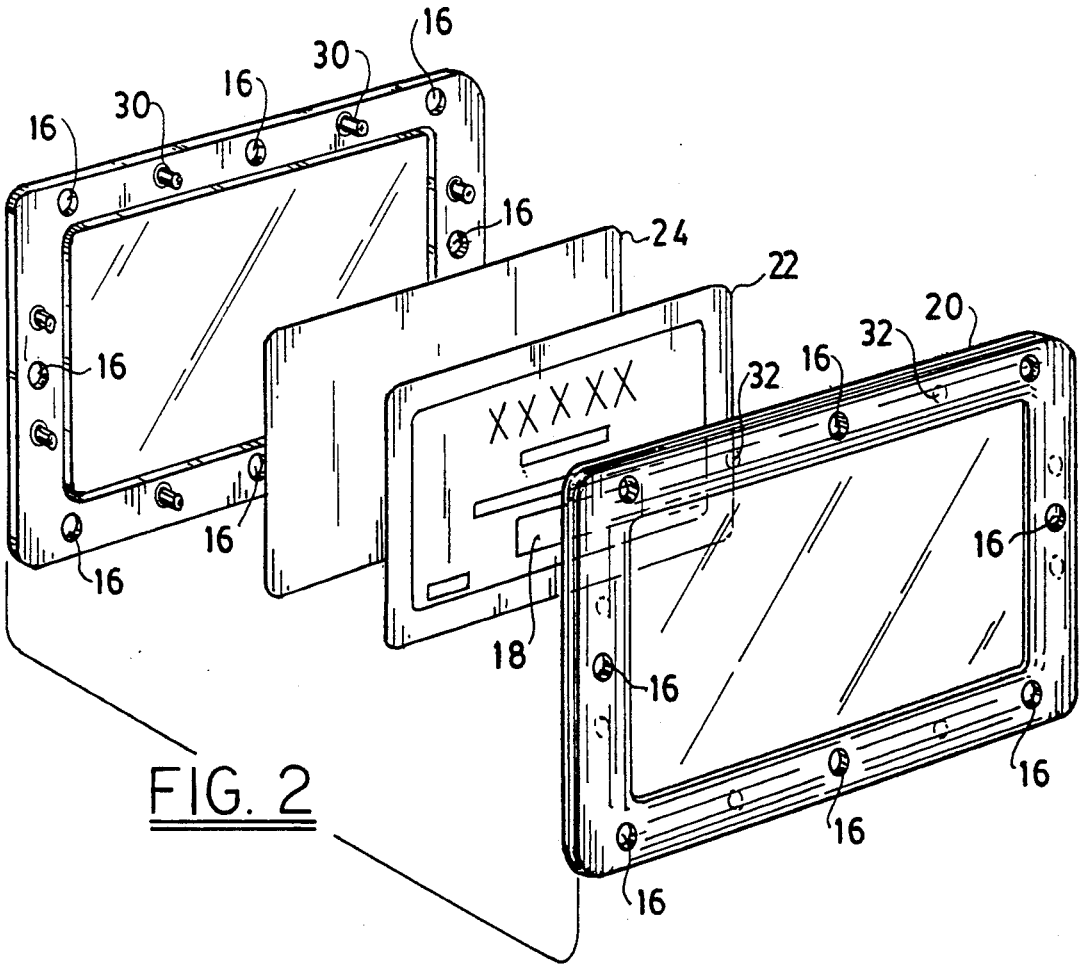
FIG. 2 is an exploded view thereof.

The construction of the tag may be more readily appreciated by referring now to FIG. 2 in which the tag is shown in an exploded view. The tag includes a base 20, one or more indicia bearing inserts or labels 22 and 24, and a cover 26. The base and cover are preferably formed from polycarbonate resin as mentioned, while the indicia bearing members are preferably formed from thin sheets of polyester selected to provide a high contrast surface when printed, for example, in a conventional laser printer. Like the housing, the indicia bearing members are selected to be free from chlorine. One or two indicia bearing members may be used. When a second is used, the indicia visible on the first is ordinarily duplicated on the second, so that the tag may be read from either side. In the alternative, one label printed on each of two sides could be used.

A plurality of aligning pins 30 is provided on the inner surface of the cover member 26 for insertion into blind bores 32 formed in the frame portion of base member 20. A plurality of aligned through mounting holes 16 is provided in the base and cover member respectively, for facilitating mounting of the tag by conventional fasteners, such as screws, wire, string or the like.

Figure 3:
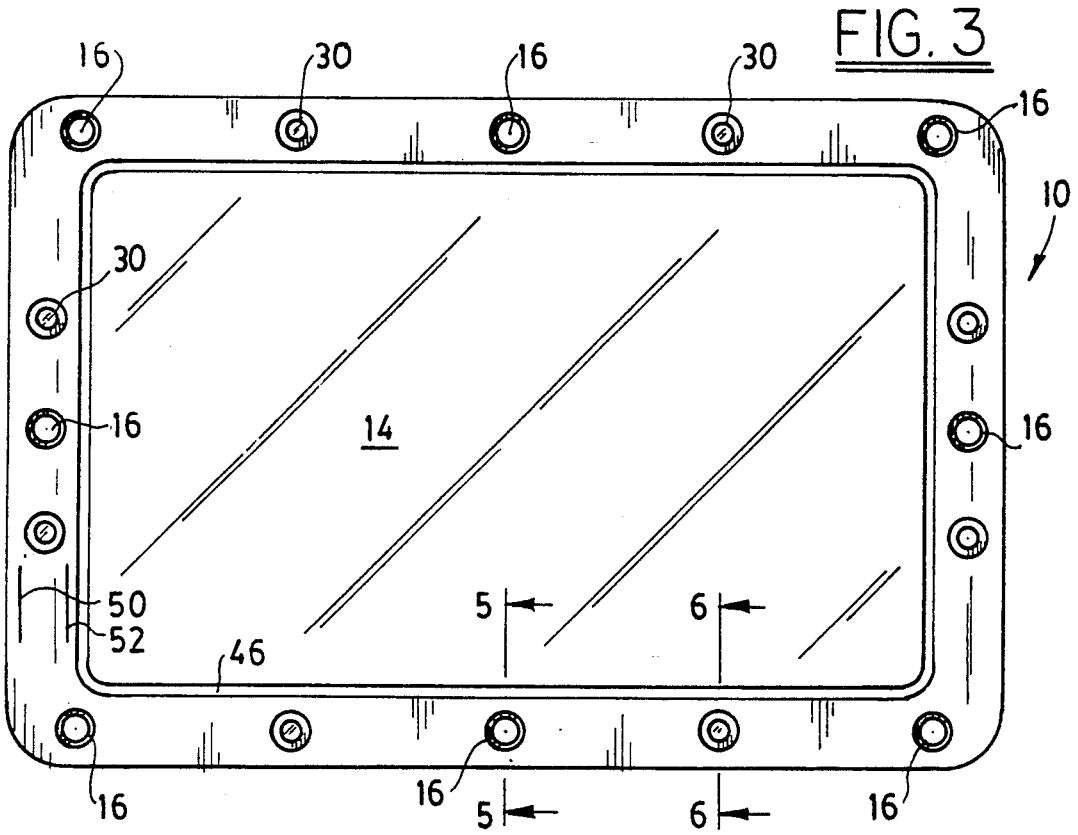
FIG. 3 is a bottom plan view of the cover portion of the tag.
Figure 4:
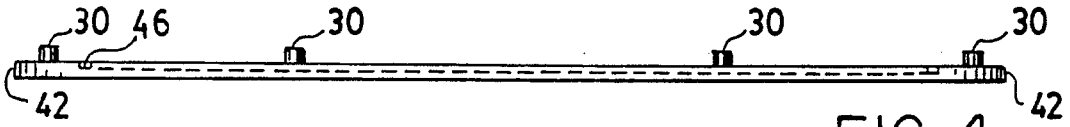
FIG. 4 is a side elevation thereof.

The construction of the cover member is shown in more detail in FIGS. 3 through 6A. As shown in FIGS. 3 and 4, the cover member has a relatively flat outer surface 40, with relatively sharp radius connections to short vertical side walls 42, to allow tamper resistant adhesive fastening to a flat surface. The short radius corners make it more difficult to pry the tag from such a surface. Aligning pins 30 are preferably spaced uniformly around the periphery of the tag, generally centrally within the width of the frame. Through holes 16 extend completely through the cover member, and are preferably provided with an enlarged countersunk recess on the inner surface of the cover member for mating with a projection on the base member, as shown and described below.

A groove 46 surrounds the transparent, window portion 14 of the tag 10 for receiving an upstanding rib on the base member, as will also be described below.

Figure 5:
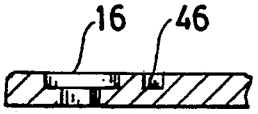
FIG. 5 is a section taken along the lines 5—5 of FIG. 3.
Figure 6:
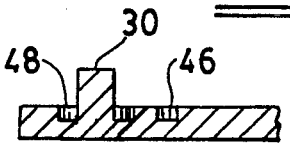
FIG. 6 is a section taken along line 6—6 of FIG. 3.

FIGS. 5 and 6 are enlarged segmental sections taken along corresponding section lines in FIG. 3, and show the through holes 16, groove 46 and pin 30 in more detail. Preferably a groove 48 surrounds each pin 30, as shown most clearly in FIG. 6, for receiving a corresponding annular projection on the base member.

Figure 5A:
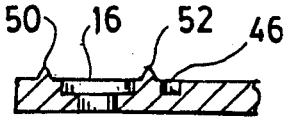
FIG. 5A is a segmental section of an alternative embodiment of the cover portion of the tag taken along the same section 5—5 as the cover portion shown in FIG. 5.
Figure 6A:
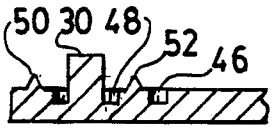
FIG. 6A is a segmental section as in FIG. 6 showing an alternative embodiment.

As shown in FIGS. 5A and 6A, ultrasonic focusing projections in the form of rings 50 and 52 in the frame portion surrounding the window portion 14 are disposed on the inside surface of the peripheral frame portion of the tag for facilitating ultrasonic welding of the tag base and tag cover. Each of the focusing or concentrating projections forms a continuous loop on the surface of the frame portion of the tag for forming a sealed cavity for the printed label, which cavity is resistant to penetration by radioactive fleas or other particles, and likewise resistant to the entry of moisture and the like. As used in its broad sense herein, seal preferably refers to an ultrasonically welded seal, but also encompasses adhesive and other seals including pressure seals formed between flat surfaces.

The base member of a tag in accordance with this invention is shown in more detail in FIGS. 7 through 12.

Figure 7:
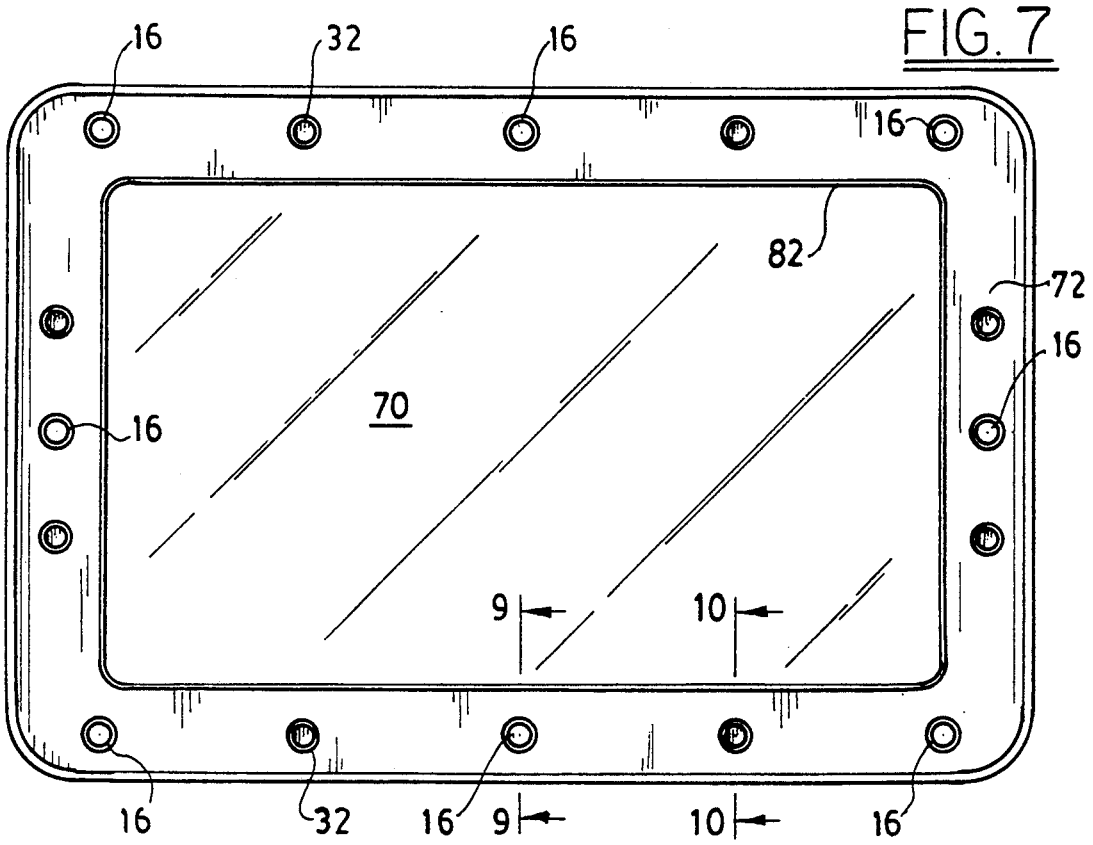
FIG. 7 is a top plan view of the base portion of the tag.
Figure 8:
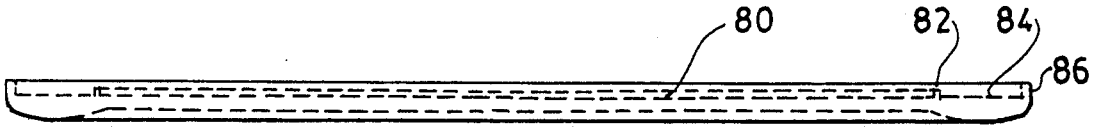
FIG. 8 is a elevation thereof.
Figure 9:
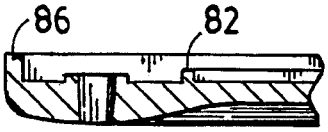
FIG. 9 is a segmental section taken along line 9—9 of FIG. 7.
Figure 10:
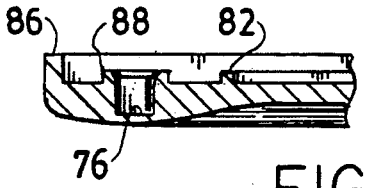
FIG. 10 is a segmental section taken along line 10—10 of FIG. 7.

FIG. 7 shows the base portion of the tag in top plan view (looking from the inside out). Like the cover, the base has a transparent window portion 70, which may be larger or smaller, but is preferably the same size and shape as the window portion 14 of the cover member. A peripheral frame 72 surrounds the transparent window portion and, as shown in FIG. 8, is preferably somewhat thicker than the window portion, so that overall, the base, and the entire tag when assembled, have a cross-sectional shape somewhat like a doughnut with a depression in the center rather than a hole. The shape resembles a dog bone with one flat surface. The thicker frame portion 72 increases the strength of the tag, and provides for the aligning and joining members, as well as the mounting holes. A plurality of blind bores 32 is disposed centrally within the frame region 72 for receiving the pins 30 of the cover member, as shown in FIGS. 10 and 12. The base is provided with an inner label receiving area 80 in registration with the transparent window portion 70 and surrounded by an upstanding peripheral rib 82 for receiving a label and maintaining it in position during assembly of the tag. In accordance with a presently preferred embodiment of the invention, the label receiving area and rib 82 are generally rectangular with slightly rounded corners 83. The rim 82 extends upwardly from the base of a larger cavity 84 for receiving the cover member. The cavity 84 is circumscribed by an upstanding peripheral rim 86 that guides and receives the cover member in registration with the base member, and preferably forms a snug fit for excluding particles and the like from entering the interior of the tag. The ribs 82 and rim 86 are shown even more clearly in FIGS. 9 through 12. The base member is also provided with through holes 16 in registration with the through holes 16 of the cover member for forming mounting holes that extend completely through the tag for attaching the tag to an article, as described above.

As can be seen most clearly in FIG. 12, when the base member and cover member are assembled, the completed tag forms an inner compartment or chamber 90 for receiving the labels. The chamber is isolated by a tortuous path over rib 82, the upstanding rim 88 surrounding blind bore 32, and rim 86 of the base. In addition, seals are preferably formed at 92 and 94, either by gluing or more preferably ultrasonic welding, for which purpose focusing projections 50 and 52 are provided, as described above. Providing a dual weld is particularly advantageous for excluding contaminated particles.

While the invention has been described in connection with a presently preferred embodiment thereof, those skilled in the art will recognize that many modifications and changes may be made therein without departing from the true spirit and scope of the invention, which accordingly is intended to be defined solely by the appended claims. For example, as mentioned, a contact adhesive or the like may be provided on the flat surface 40 of the cover for adhesively securing the tag to a labelled article. The frame portion of the tag may be color coded and/or finished in a matte or similar finish to provide a distinctive appearance.

What is claimed is:

1. A sealed tamper resistant tag comprising:

at least substantially chlorine free base means;

a transparent window comprising at least a portion of the base means;

a peripheral frame portion on the base means surrounding the window, the tag being thicker at the frame than at the window;

a first upstanding rib on the base means for receiving and positioning an indicia bearing insert with at least a portion thereof visible within the window;

first alignment means on the frame;

a peripheral rim on the base surrounding the frame portion;

a least substantially chlorine free cover means disposed within the peripheral rim;

transparent window means on the cover means;

a frame portion on said cover means at least substantially surrounding the window portion of said cover means;

second alignment means on the cover means cooperating with said first alignment means for aligning the cover and base relative to each other with the transparent window portions of the cover and the base at least substantially in registration;

a recess in the cover means for receiving the first upstanding rib;

at least one seal formed between the cover and the base at least substantially surrounding the window portions of the cover and the base between the upstanding rib and the peripheral rim for forming a sealed chamber for receiving the indicia bearing insert; and a plurality of aligned through mounting holes in the frame portions of the base means and the cover means for allowing the tag to be hung in at least two different orientations.

2. The sealed tamper resistant tag of claim 1 in which the base means comprises a unitary plastic member, in which the transparent window comprises an at least substantially flat centrally disposed generally rectangular portion of the base means; and the peripheral frame portion comprises an extension of the flat window contiguous therewith and having at least one rounded surface.

3. The sealed tamper resistant tag of claim 1 in which the cover means comprises an at least substantially flat mounting surface;

the frame portion comprises a continuous side wall; and also comprising a short radius tamper resistant connection between the side wall and the flat surface.

4. The sealed tamper resistant tag of claim 1 further comprising a printed indicia bearing member disposed within the sealed chamber.

5. The sealed tamper resistant tag of claim 1 in which the second alignment means comprises a plurality of upstanding pins on the cover means, and the first alignment means comprises a plurality of blind bores in the base means in registration with the pins.

6. The sealed tamper resistant tag of claim 1, in which the at least one seal comprises ultrasonic focusing means in said frame portion of said cover means.

7. The sealed tamper resistant tag of claim 6 in which the ultrasonic focusing means comprises projections extending upwardly from a surface of the cover means for engaging the frame portion of the base means, when the tag is assembled.

* * * * *